US008153569B2

(12) United States Patent
Kuratomi et al.

(10) Patent No.: US 8,153,569 B2
(45) Date of Patent: Apr. 10, 2012

(54) LUBRICANT BASE OIL

(75) Inventors: Tadashi Kuratomi, Fukuoka (JP); Katsumi Nagano, Aichi (JP)

(73) Assignee: Nippon Steel Chemical Co., Ltd., Tokyo (JP)

( * ) Notice: Subject to any disclaimer, the term of this patent is extended or adjusted under 35 U.S.C. 154(b) by 458 days.

(21) Appl. No.: 12/225,657

(22) PCT Filed: Mar. 27, 2007

(86) PCT No.: PCT/JP2007/056338

§ 371 (c)(1), (2), (4) Date: Sep. 26, 2008

(87) PCT Pub. No.: WO2007/116725

PCT Pub. Date: Oct. 18, 2007

(65) Prior Publication Data

US 2009/0233824 A1 Sep. 17, 2009

(30) Foreign Application Priority Data

Mar. 30, 2006 (JP) ..... 2006-093945

(51) Int. Cl.
*C08G 63/00* (2006.01)
*C10M 105/36* (2006.01)

(52) U.S. Cl. ..... 508/496; 508/494

(58) Field of Classification Search ..... 508/494, 508/496

See application file for complete search history.

(56) References Cited

U.S. PATENT DOCUMENTS

| | | | | |
|---|---|---|---|---|
| 2006/0019840 | A1* | 1/2006 | Kawahara et al. | 508/280 |
| 2006/0154833 | A1* | 7/2006 | Katou et al. | 508/539 |

FOREIGN PATENT DOCUMENTS

| | | |
|---|---|---|
| JP | 59-066495 | 4/1984 |
| JP | 02-041392 | 2/1990 |
| JP | 04-146995 | 5/1992 |
| JP | 04-356441 | 12/1992 |
| JP | 09-279172 | 10/1997 |
| JP | 2001-107066 | 4/2001 |
| JP | 2003-321691 | 11/2003 |
| JP | 2005-194303 | 7/2005 |
| JP | 2006-096849 | 4/2006 |
| JP | 2006-274057 | 10/2006 |

OTHER PUBLICATIONS

International Search Report mailed Jun. 5, 2007, issued on PCT/JP2007/056338.

Response under Article 11 of the Law dated Jan. 31, 2008, submitted on PCT/JP2007/056338.

Response under Article 11 of the Law dated Jul. 11, 2008, submitted on PCT/JP2007/056338.

* cited by examiner

*Primary Examiner* — Walter D Griffin

*Assistant Examiner* — Francis C Campbell

(74) *Attorney, Agent, or Firm* — Edwards Wildman Palmer LLP

(57) ABSTRACT

Disclosed is lubricant base oil that is excellent in lubricity, sludge solubility, low viscosity, and low temperature characteristics and capable of realizing low volatility. The lubricant base oil contains as its main component a diester or triester synthesized from a divalent or trivalent carboxylic acid of 9 or less carbon atoms and a monovalent glycol ether such as an alkylene glycol monoalkyl ether of 3 to 25 carbon atoms and is useful as base oil for lubricating oil and grease. Di(hexyloxyethyl) adipate may be cited as an appropriate example of the diester.

20 Claims, No Drawings

LUBRICANT BASE OIL

TECHNICAL FIELD

This invention relates to synthetic lubricant base oil and, specifically, to base oil useful for a whole range of industrial lubricants. More particularly, this invention relates to base oil that has low volatility and excellent low-temperature fluidity and is capable of displaying lubricity in a wide temperature range over a prolonged period of time.

BACKGROUND TECHNOLOGY

Base oil for fluid and grease lubricants is required to perform stably over a prolonged period of time, that is, it is required to have low volatility, excellent heat and oxidation stability, good cold-start properties (low-temperature fluidity), and high viscosity index (wide range). It is no exaggeration to say that an ultimate object of base oil is to have the outstanding properties of low volatility and low viscosity. A large number of compounds have been proposed as lubricant base oil which satisfies these properties. Some of them have succeeded to some extent, but none has attained the ultimate object of satisfactory performance in a range of low viscosity and low volatility at the present time. Acquiring low viscosity and low volatility at the same time implies acquiring two mutually exclusive properties at the same time: for example, an attempt to reduce viscosity of a molecule while maintaining the same structure would reduce the molecular weight, but inevitably increase the volatility.

A polyol ester exists as a product claimed to be free from the aforementioned defect. A polyol ester is bulkier than hydrocarbon-based synthetic oil such as poly-α-olefin and is lower in viscosity than poly-α-olefin when compared at the same viscosity. Moreover, a polyol ester shows excellent heat stability as the raw material alcohol for it such as neopentyl glycol and pentaerythritol does not have a hydrogen atom at the β-position. However, a polyol ester is generally inferior in low-temperature fluidity to and lower in viscosity index than a diester. Hence, a polyol ester cannot satisfy the aforementioned properties.

Patent document 1: JP2003-321691 A

Patent document 2: JP2-041392 A

A polyol ester obtained by the reaction of 4-diethyl-1,5-pentanediol with n-octanoic acid is proposed in patent document 1. This synthesis was carried out to improve the molecular flexibility of the neopentyl group and carbonyl group. However, even the procedure described in the document is unable to yield a polyol ester capable of satisfying the aforementioned properties.

An ester obtained from a dibasic or tribasic acid of 10 or more carbon atoms and a polyalkylene glycol monoalkyl ether is proposed in patent document 2. However, a diester of this kind shows high viscosity as the number of carbon atoms is large. A compound cited in the document has a viscosity of 14 cps or more at 50° C. and it cannot be said to have a characteristic property of low viscosity.

DISCLOSURE OF THE INVENTION

Problems to be Solved by the Invention

An object of this invention is to provide lubricant base oil that satisfies the requirements for low volatility, excellent heat and oxidation stability, good cold-start properties (low-temperature fluidity) and, in particular, displays excellent characteristics of low viscosity and low volatility at the same time.

Means to Solve the Problems

This invention relates to lubricant base oil which comprises a diester or triester synthesized from a divalent or trivalent carboxylic acid of 9 or less carbon atoms and a monovalent glycol ether. Here, the lubricant base oil is obtained advantageously if one or more of the following conditions are satisfied: the monovalent glycol ether has 3 to 25 carbon atoms; the monovalent glycol ether is an alkylene glycol monoalkyl ether; the carboxylic acid is a divalent carboxylic acid; and one or both of the carboxylic acid and the monovalent glycol ether have a branched alkyl group.

The lubricant base oil of this invention will be described below. The lubricant as used in this invention comprises both oil and grease. Therefore, lubricant base oil comprises base oil for lubricant oil and base oil for grease.

The main component of the lubricant base oil of this invention is a liquid ester synthesized from a divalent or trivalent carboxylic acid and a monovalent glycol ether. The liquid ester advantageously accounts for 50 wt % or more, preferably 80 wt % or more, of the lubricant base oil. According to this invention, one kind or two kinds or more of the aforementioned esters may be used depending upon end use and property requirements. Further, the lubricant base oil of this invention can be used together with one kind or more of compounds selected from the group of mineral oil, poly-α-olefin, polybutene, polyisobutylene, animal and vegetable oils, esters (exclusive of the aforementioned esters), alkylbenzene, synthetic aromatic or alicyclic hydrocarbons, polyalkylene glycols, polyvinyl ether, polyphenyl ether, alkyl(di)phenyl ether, and silicone as a part of base oil to the extent that the use of such additives does not deteriorate the performance of the base oil. The use of the aforementioned poly-α-olefin or esters helps to provide excellently balanced low viscosity and low volatility when used together with the liquid ester of this invention.

The monovalent glycol ether has 3 to 25, preferably 5 to 15, carbon atoms. An ester of less than 3 carbon atoms has a low boiling point and this makes it difficult to secure low volatility. On the other hand, an ester having carbon atoms in excess of 25 presents a problem in securing low viscosity and low-temperature fluidity. One kind of the monovalent glycol ether or two kinds or more may be used in the synthesis.

A preferable example of the monovalent glycol ether is represented by the following formula (I):

$$\text{HO—R1-O—R2} \quad (1)$$

where R1 is an alkylene group represented by $C_pH_{2p}$, R2 is an alkyl group represented by $C_nH_{2n+1}$, p is preferably in the range of 1 to 5, and n is preferably in the range of 1 to 12.

Examples of R1 include an ethylene group, a 1-methylethylene group, a 2-methylethylene group, a propylene group, a butylene group, and an isobutylene group. Examples of R2 include a methyl group, an ethyl group, a propyl group, an isopropyl group, a butyl group, an isobutyl group, a pentyl group, a cumyl group, a hexyl group, a 1,4-dimethylbutyl group, an octyl group, a 2-ethylhexyl group, a nonyl group, a 3,5,5-trimethylhexyl group, and a decyl group.

Any alkylene glycol monoalkyl ether comprising the aforementioned R1 and R2 groups is used preferably as it facilitates the production of lubricant oil and grease having low volatility, low viscosity, and high heat resistance in good balance. In this case, the hydrocarbon chain may be either linear or branched and the carbon atom bonded to the hydroxyl group may be either primary or secondary. Furthermore, although both R1 and R2 can be linear, at least one of them is preferably branched.

There is no specific restriction on the divalent or trivalent carboxylic acids as long as the number of carbon atoms is 9 or less, although aliphatic carboxylic acids are preferred. The divalent carboxylic acids include oxalic acid, malonic acid, succinic acid, glutaric acid, adipic acid, pimelic acid, suberic acid, azelaic acid, dimethylsuccinic acid, methyladipic acid, and dimethylglutaric acid. The trivalent carboxylic acids include 1,2,4-butanetricarboxylic acid. The use of divalent carboxylic acids is desirable for the production of lubricant oil and grease at low cost. These carboxylic acids are used singly or as a mixture of two kinds or more.

The method for synthesizing esters from the aforementioned carboxylic acids and monovalent glycol ethers is publicly known. Concretely, the esterification reaction is carried out at high temperature while removing water formed by the condensation reaction. It is possible to use a catalyst such as sulfuric acid and para-toluenesulfonic acid or to use a dehydrating solvent such as toluene, ethylbenzene, and xylene. When a trivalent carboxylic acid is used, one mole of a trivalent carboxylic acid is allowed to react with three moles of a monovalent glycol ether.

An ester synthesized in the aforementioned manner from a carboxylic acid and a monovalent glycol ether, one or both of which have a branched alkyl group, is preferred as it readily provides good fluidity at low temperature.

Examples of the monovalent glycol ethers having a branched alkyl group include the compounds represented by formula (1) wherein R1 is a 1-methylethylene group or a 2-methylethylene group or R2 is an isobutyl group or a 2-ethylhexyl group. Examples of the branched divalent or trivalent carboxylic acids include dimethylsuccinic acid, methyladipic acid, and dimethylglutaric acid.

The lubricant base oil of this invention can be used as base oil for lubricant oil and grease and, in order to improve the performance of lubricants containing this base oil, it is allowable to add one kind or more of known additives such as antioxidants, oiliness improvers, antiwear agents, extreme pressure agents, metal inactivating agents, rust preventing agents, viscosity index improvers, pour point depressants, and anti-foaming agents. These additives are added preferably at a rate of 0.01 to 10 mass %, more preferably at a rate of 0.03 to 5 mass %, in relation to the lubricant base oil.

A thickener to be used for grease prepared from the lubricant base oil of this invention is not specifically limited and any of thickeners commonly used for grease can be used; for example, metallic soaps, complex soaps, urea, organic bentonites, and silica. The content of a thickener in the grease of this invention is normally 3 to 30 mass %. It is allowable to compound the grease of this invention with one kind or two kinds or more of additives generally used for grease such as antioxidants, extreme pressure agents, rust preventing agents, metal corrosion preventing agents, oiliness improvers, viscosity index improvers, pour point depressants, and adhesion improvers. These additives are added preferably at a rate of 0.01 to 10 mass %, more preferably at a rate of 0.03 to 5 mass %, in relation to the grease base oil. The grease of this invention can be produced according to a known method.

The lubricant base oil of this invention in the form of lubricant oil is applicable not only to industrial lubricants such as hydraulic oil, gear oil, spindle oil, and bearing oil but also to a variety of machine elements such as dynamic pressure bearings, sintered oil-containing bearings, hinges, sewing machines, and sliding surface bearings. Further, the lubricant base oil of this invention in the form of grease is applicable to various parts requiring lubrication such as bearings (ball, roller, and needle), sliding parts, and gears.

PREFERRED EMBODIMENTS OF THE INVENTION

Synthetic Example 1

In a reactor consisting of a 300-cc four-necked flask, a stirrer, a thermometer, a nitrogen inlet tube, a nitrogen line, a Dean-Stark tube, a condenser, a three-way cock, and a vacuum apparatus were placed 36.54 g (0.25 mole) of adipic acid, 87.74 g (0.60 mole) of ethylene glycol mono-n-hexyl ether, 2.38 g (0.0125 mole) of para-toluenesulfonic acid monohydrate, and 86 g of toluene and the mixture was allowed to react with stirring at 85° C. for 30 hours in a nitrogen atmosphere. An aqueous solution of sodium hydroxide was added to the reaction mixture to neutralize the para-toluenesulfonic acid and the oily layer was separated from the aqueous layer. The oily layer was washed with alkali and then with water and the oily layer was separated and dried over anhydrous sodium sulfate. The oil was stripped of water, ethylbenzene, and the unchanged ethylene glycol mono-n-hexyl ether by distillation to yield di(hexyloxyethyl) adipate.

Synthetic Example 2

Di(butoxypropyl) azelate was obtained in the same manner as in Synthetic Example 1 with the exception of using 47.06 g (0.25 mole) of azelaic acid as a carboxylic acid and 79.32 g (0.60 mole) of propylene glycol mono-n-butyl ether (wherein the propylene group is an isomeric mixture of a 1-methylethylene group and a 2-methylethylene group) as a glycol ether. The product di(butoxypropyl) azelate is a mixture mainly composed of di(butoxy-1-methylethyl) azelate and di(butoxy-2-methylethyl) azelate.

Synthetic Example 3

Di(hexyloxyethyl)methyladipate was obtained in the same manner as in Synthetic Example 1 with the exception of using 40.06 g (0.25 mole) of methyladipic acid as a carboxylic acid and 87.74 g (0.60 mole) of ethylene glycol mono-n-hexyl ether as a glycol ether.

Synthetic Example 4

Di(butoxypropyl) dodecanedioate was obtained in the same manner as in Synthetic Example 1 with the exception of using 57.58 g (0.25 mole) of dodecanedioic acid as a carboxylic acid and 79.32 g (0.60 mole) of propylene glycol mono-n-butyl ether as a glycol ether. The product di(butoxypropyl) dodecanedioate is a mixture mainly composed of di(butoxy-1-methylethyl) dodecanedioate and di(butoxy-2-methyethyl) dodecanedioate.

EXAMPLES

This invention will be described below with reference to the examples and comparative examples.

Examples 1-5 and Comparative Examples 1-2

The evaporation test with a thermobalance was carried out to evaluate the relationship between viscosity and rate of evaporation of respective base oil. Base oils showing excellent rotational characteristics at low temperature and minimal rate of evaporation were evaluated under the same conditions. The following compounds were tested as base oil: di(hexyloxyethyl) adipate of Synthetic Example 1 in Example 1; di(butoxypropyl) azelate of Synthetic Example 2 in Example 2; di(hexyloxyethyl)methyladipate of Synthetic Example 3 in Example 3; a mixture of 65 parts by weight of di(butoxypropyl) azelate of Synthetic Example 2 and 35 parts by weight of diusooctyl adipate (Hatcol 2906 manufactured by Hatco Corporation) in Example 4; a mixture of 75 parts by weight of di(hexyloxyethyl) adipate of Synthetic Example 1 and 25 parts by weight of poly-α-olefin (PAO3 manufactured by Chevron) in Example 5; di(butoxypropyl) dodecanedioate of Synthetic Example 4 in Comparative Example 1; and a neopentyl glycol ester (Hatcol 2962 manufactured by Hatco Corporation) in Comparative Example 2. The properties of respective base oil were evaluated and the results are shown in Table 1.

TABLE 1

| | Example | | | | | Comparative example | |
|---|---|---|---|---|---|---|---|
| | 1 | 2 | 3 | 4 | 5 | 1 | 2 |
| Kinematic viscosity at 40° C., $mm^2/s$ | 10.0 | 10.8 | 10.3 | 10.4 | 11.0 | 11.7 | 8.7 |
| Kinematic viscosity at −10° C., $mm^2/s$ | 77 | 92 | 83 | 87 | 99 | 111 | 72 |
| Decrease in weight, mass % | 0.80 | 0.50 | 0.75 | 0.75 | 0.95 | 0.35 | 3.10 |
| Judgment on viscosity | G | G | G | G | G | NG | G |
| Judgment on evaporation characteristics | G | G | G | G | G | G | NG |

The rate of evaporation was measured as follows:

Apparatus: thermobalance (manufactured by PerkinElmer, Inc.)

Amount of sample lubricant: 20 mg

Temperature at which the sample is left standing: 120° C. (in the air)

Time during which the sample is left standing: 480 minutes

The decrease in weight from the initial weight was measured and a decrease of less than 1.0 wt % was judged to have passed the test and marked G while a decrease of 1.0 wt % or more was judged to have failed the test and marked NG.

The kinematic viscosity was measured in conformity to JIS K 2283 and a sample showing a value of less than 110 $mm^2/s$ at −10° C. was judged G (passing the test) and a sample showing a value of 110 $mm^2/s$ or more at −10° C. was judged NG (failing the test).

Examples 6-10 and Comparative Examples 3-4

The base oils of Examples 1-5 and Comparative Examples 1-2 were respectively compounded by a known method with 12 wt % of lithium stearate as a thickener and 0.5 wt % of a known antioxidant (an alkyldiphenylamine; Irganox L57) to give grease. Each grease was evaluated for lifetime at 150° C. by submitting it to a life test (continuous run, by the use of a sealed bearing) in a tester specified by ASTM D1741 (withdrawn). Base oil showing a lifetime of 300 hours or more was judged to have passed the test. Furthermore, the coefficient of static friction was measured 10 seconds after the start with a Suzuki friction and wear tester while setting the sliding speed at 2.4 m/s and the contact pressure at 15 $kg/cm^2$. The rotary plate test piece was made of DLC-coated S45C and the fixed test piece was made of S45C. Coating with DLC enables measurement of the friction coefficient of grease without being influenced by wear. Grease showing a coefficient of static friction of less than 0.15 was judged G (passing the test).

The results of evaluation are shown in Table 2. The grease of Example 6 was prepared from the base oil of Example 1, the grease of Example 7 from the base oil of Example 2, the grease of Example 8 from the base oil of Example 3, the grease of Example 9 from the base oil of Example 4, the grease of Example 10 from the base oil of Example 5, the grease of Comparative Example 3 from the base oil of Comparative Example 1, and the grease of Comparative Example 4 from the base oil of Comparative Example 2.

TABLE 2

| | Example | | | | | Comparative example | |
|---|---|---|---|---|---|---|---|
| | 6 | 7 | 8 | 9 | 10 | 3 | 4 |
| Lifetime, h | 330 | 400 | 380 | 330 | 310 | 420 | 250 |
| Judgment on lifetime | G | G | G | G | G | G | G |
| Coefficient of static friction | 0.12 | 0.12 | 0.12 | 0.12 | 0.14 | 0.18 | 0.10 |
| Judgment on coefficient of friction | G | G | G | G | G | NG | G |

Table 1 indicates that the base oils in Examples 1, 2, and 3 are excellent in evaporation characteristics and low-temperature rotational characteristics. On the other hand, the base oil in Comparative Example 1 is excellent in evaporation characteristics, but inferior in low-temperature characteristics. In contrast, the base oil in Comparative Example 2 is excellent in low-temperature characteristics, but inferior in evaporation characteristics. These results prove superiority of the base oil of this invention. Furthermore, as shown in Table 2, the greases in the examples are comparable in lifetime to and lower in coefficient of static friction than the greases in the comparative examples. The use of the base oil of this invention can yield grease of long lifetime and low friction.

Industrial Applicability

The lubricant base oil of this invention has both an ester linkage and an ether linkage and shows high polarity and excellent lubricity and sludge solubility. Low volatility is realized by increasing the number of oxygen atoms (high polarity) and good low-temperature characteristics are realized by providing the ester with a branched chain. Thus, a fluid lubricant to be obtained from this base oil is capable of attaining the ultimate object of low viscosity and low volatility. The synthetic lubricant base oil of this invention exhibits low volatility and excellent evaporation characteristics and can maintain lubricity stably over a prolonged period of time. Further, grease prepared from the synthetic lubricant base oil of this invention has characteristics of grease superior to those of the existing esters while maintaining the excellent characteristics of the base oil. In particular, the grease of this invention is lower in viscosity than and superior in evaporation characteristics to a neopentyl glycol ester that is one of the existing low-viscosity esters said to be well balanced in viscosity and evaporation characteristics. This is said to be a noteworthy accomplishment without exaggeration. Hence, the lubricant base oil of this invention will likely contribute to development of lubricating oils for bearings to be used under the conditions of severe temperature change and of a variety of other industrial lubricating oils. The lubricant base oil of this invention is particularly suitable as base oil for lubricating oils for sintered oil-containing bearings or fluid bearings. The lubricating oils produced from the lubricant base oil of this invention produce excellent effects when used as sewing machine oil, sliding surface oil, hydraulic oil, gear oil, lubricating oil for sewing machines, bearing oil, dynamic pressure bearing oil, and sintered oil-containing bearing oil. Grease produced from the lubricant base oil of this invention is suitably sealed in roller bearings to be used at high rotational speed or applied to sliding gears and other sliding parts moving at high speed.

The invention claimed is:

1. Lubricant base oil comprising a diester synthesized from a divalent aliphatic carboxylic acid of 9 or less carbon atoms and a monovalent alkylene glycol monoalkyl ether of 3 to 25 carbon atoms represented by the following formula (1):

HO—R1-O—R2 (1)

where R1 is an alkylene group represented by $C_pH_{2p}$, R2 is an alkyl group represented by $C_nH2_{n+1}$, p is in the range of 1 to 5, and n is in the range of 1 to 12.

2. Lubricant base oil as described in claim 1 wherein at least one of the carboxylic acid and the monovalent glycol ether has an alkyl group of branched structure.

3. Lubricant base oil as described in claim 1 wherein the diester is di(hexyloxyethyl) adipate.

4. Lubricant base oil as described in claim 1 wherein the diester is di(butoxypropyl) azelate.

5. Lubricant base oil as described in claim 1 wherein the diester is di(hexyloxyethyl) methyladipate.

6. A grease comprising the lubricant base oil described in claim 1 and a thickener.

7. Lubricant base oil comprising a diester synthesized from a divalent aliphatic carboxylic acid of 9 or less carbon atoms and a monovalent glycol ether represented by the following formula (1);

HO—R1-O—R2 (1)

where R1 is a 1-methylethylene group or a 2-methylethylene group and R2 is an alkyl group of 1 to 12 carbon atoms.

8. A grease comprising the lubricant base oil described in claim 7 and a thickener.

9. A grease comprising the lubricant base oil as described in claim 2 and a thickener.

10. A grease comprising the lubricant base oil as described in claim 3 and a thickener.

11. A grease comprising the lubricant base oil as described in claim 4 and a thickener.

12. A grease comprising the lubricant base oil as described in claim 5 and a thickener.

13. The lubricant base oil as described in claim 1 wherein the divalent aliphatic carboxylic acid is a divalent aliphatic carboxylic of 6-9 carbon atoms.

14. The lubricant base oil as described in claim 1 wherein the monovalent alkylene glycol monoalkyl ether is monovalent alkylene glycol monoalkyl ether represented by the following formula (1):

HO—R1-O—R2 (1)

where R1 is an alkylene group represented by $C_pH_{2p}$, R2 is an alkyl group represented by $C_nH2_{n+}$, p is in the range of 1 to 5, and n is in the range of 1 to 12.

15. The lubricant base oil as described in claim 1 wherein the divalent aliphatic carboxylic acid is a divalent aliphatic carboxylic acid of 6-9 carbon atoms and the monovalent alkylene glycol monoalkyl ether is divalent aliphatic carboxylic acid represented by the following formula (1):

HO—R1-O—R2 (1)

where R1 is an alkylene group represented by $C_pH_{2p}$, R2 is an alkyl group represented by $C_nH2_{n+}$, p is in the range of 1 to 5, and n is in the range of 1 to 12.

16. The lubricant base oil as described in claim 1 wherein the diester is diester represented by the following (2):

R2-O—R1-O—OC—R—CO—O—R1-O—R2 (2)

where R is an aliphatic group of 4-7 carbon atoms, R1 is an alkylene group represented by $C_pH_{2p}$, R2 is an alkyl group represented by $C_nH2_{n+}$, p is in the range of 1 to 5, and n is in the range of 1 to 12.

17. The lubricant base oil as described in claim 1 wherein the diester is diester represented by the following (2):

R2-O—R1-O—OC—R—CO—O—R1-O—R2 (2)

where R is an alkylene group of 4-7 carbon atoms, R1 is an alkylene group represented by $C_pH_{2p}$, R2 is an alkyl group represented by $C_nH2_{n+l}$, p is in the range of 1 to 5, and n is in the range of 1 to 12.

18. The lubricant base oil as described in claim 1 wherein the divalent aliphatic carboxylic acids include oxalic acid, malonic acid, succinic acid, glutaric acid, adipic acid, pimelic acid, suberic acid, azelaic acid, dimethylsuccinic acid, methyladipic acid and dimethylglutaric acid.

19. The grease according to claim 6 wherein the thickener is lithium stearate.

20. The grease according to claim 8 wherein the thickener is lithium stearate.

* * * * *